US009671721B1

(12) United States Patent
Wu

(10) Patent No.: US 9,671,721 B1
(45) Date of Patent: Jun. 6, 2017

(54) TONER CARTRIDGE

(71) Applicant: GENERAL PLASTIC INDUSTRIAL CO., LTD., Taichung (TW)

(72) Inventor: Yi-Chia Wu, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/226,115

(22) Filed: Aug. 2, 2016

(30) Foreign Application Priority Data

May 2, 2016 (TW) ..... 105113642 A

(51) Int. Cl.
*G03G 15/08* (2006.01)

(52) U.S. Cl.
CPC ..... *G03G 15/0867* (2013.01)

(58) Field of Classification Search
CPC ..... G03G 15/0867
See application file for complete search history.

(56) References Cited

U.S. PATENT DOCUMENTS

2001/0008593 A1* 7/2001 Tsuji ..... G03G 15/0872 399/262
2002/0102113 A1* 8/2002 Kusano ..... G03G 15/0872 399/262
2007/0077100 A1* 4/2007 Suzuki ..... G03G 15/0872 399/262

FOREIGN PATENT DOCUMENTS

JP 2016170322 A * 9/2016

* cited by examiner

*Primary Examiner* — Francis Gray
(74) *Attorney, Agent, or Firm* — Muncy, Geissler, Olds & Lowe, P.C.

(57) ABSTRACT

A toner cartridge includes a shell, a sleeve and a knocking block. The shell has an internal space, an opening communicating with the internal space and exterior of the shell, and an imaginary axis. The shell is rotatable about the imaginary axis. The sleeve is disposed at an outside of the shell and includes an internal path extended along an imaginary line not parallel to the imaginary axis, and two stopping portions located at two ends of the internal path. The knocking block is accommodated in the internal path, and movable along the internal path to knock the stopping portion when the shell rotates, so as to vibrate the shell, so that the carbon powder sticking on the inner wall of the toner cartridge can be shaken off and then discharged by the toner cartridge. Therefore, the remnant carbon powder in the toner cartridge is effectively decreased.

12 Claims, 6 Drawing Sheets

TONER CARTRIDGE

BACKGROUND OF THE INVENTION

1. Field of the Invention

The present invention relates to a powder container and more particularly, to a toner cartridge for an electronic imaging device.

2. Description of the Related Art

The toner cartridge is one of the most important components in the electronic imaging device, and the technical core of the development of the electronic imaging device. At present, although there have been many options of toner cartridges with different structures for the user, to improve the design and the function of the toner cartridge, such as to decrease the remnant carbon powder of the toner cartridge, is an objective for the dealers in the related field.

SUMMARY OF THE INVENTION

It is an objective of the present invention to provide a toner cartridge which can decrease the remnant carbon powder therein.

To attain the above objective, the present invention provides a toner cartridge which includes a shell, a sleeve and a knocking block. The shell has an internal space, an opening communicating with the internal space and exterior of the shell, and an imaginary axis. The shell is rotatable about the imaginary axis. The sleeve is disposed at an outside of the shell and includes an internal path extended along an imaginary line not parallel to the imaginary axis, and two stopping portions located at two ends of the internal path. The knocking block is accommodated in the internal path of the sleeve, and movable along the internal path to knock the stopping portion when the shell rotates.

When the knocking block knocks the stopping portion, the shell of the toner cartridge can be vibrated, so that the carbon powder sticking on the inner wall of the toner cartridge can be shaken off and then discharged by the toner cartridge. Therefore, the remnant carbon powder in the toner cartridge is effectively decreased.

DETAILED DESCRIPTION OF THE INVENTION

Figure 1:
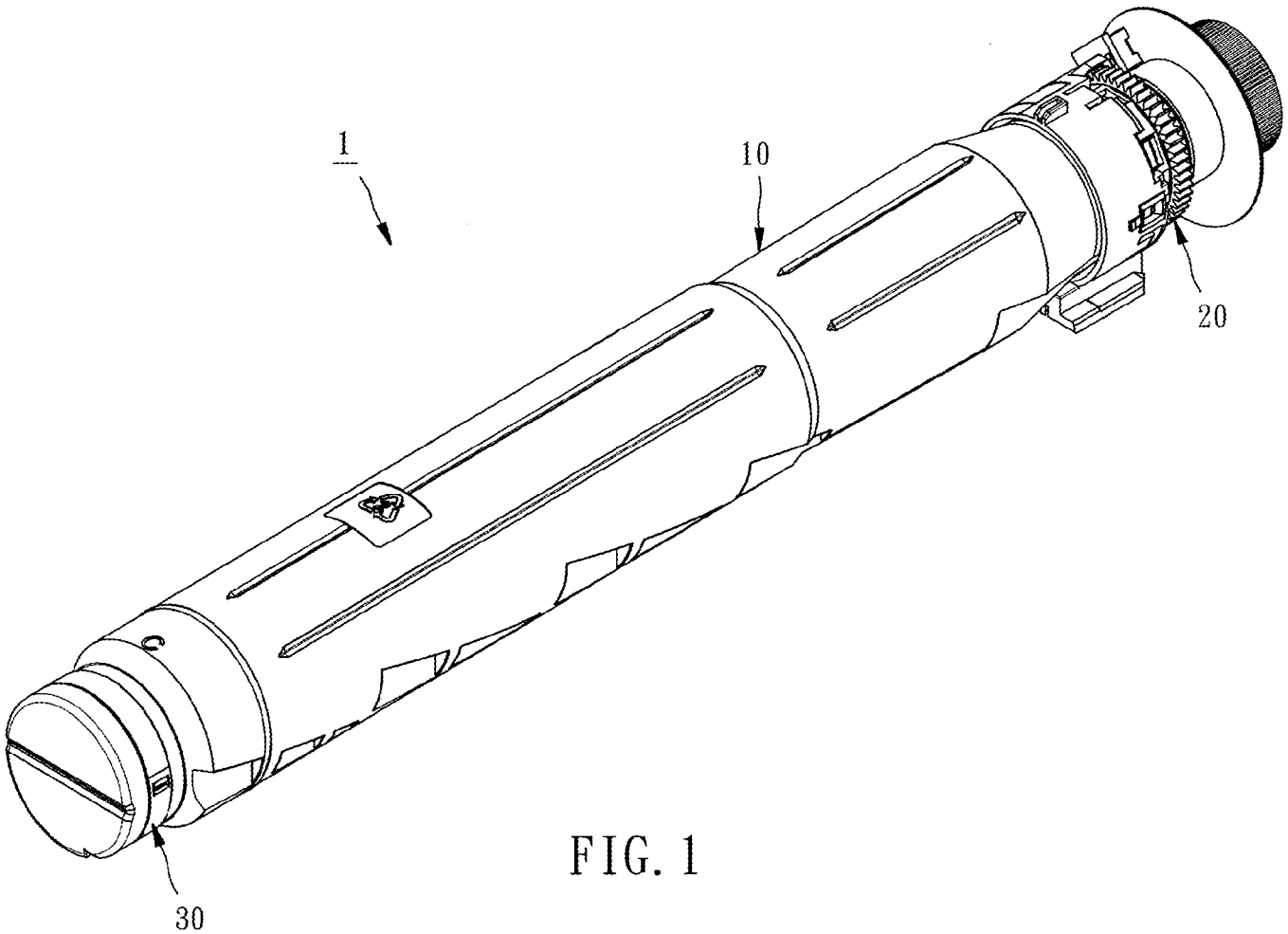
FIG. 1 is an assembled perspective view of a toner cartridge according to a preferred embodiment of the present invention.
Figure 2:
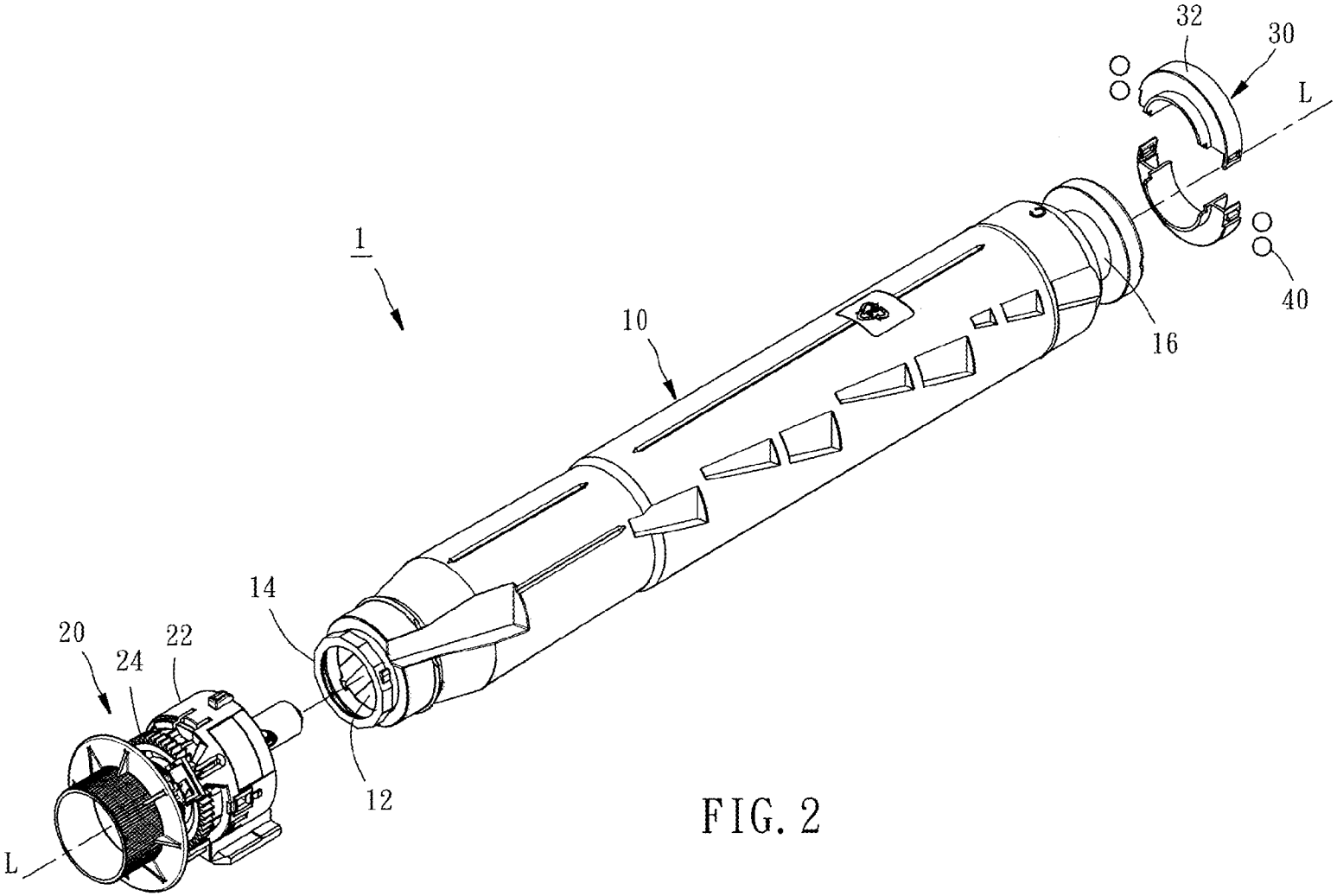
FIG. 2 is an exploded perspective view of the toner cartridge according to the preferred embodiment of the present invention.

Referring to FIGS. 1-2, a toner cartridge 1 according to a preferred embodiment of the present invention includes a shell 10, a transmission member 20, a sleeve 30, and four knocking blocks 40. The toner cartridge 1 is adapted to be installed in an electronic imaging device (not shown), such as a printer or a copy machine.

Figure 3:
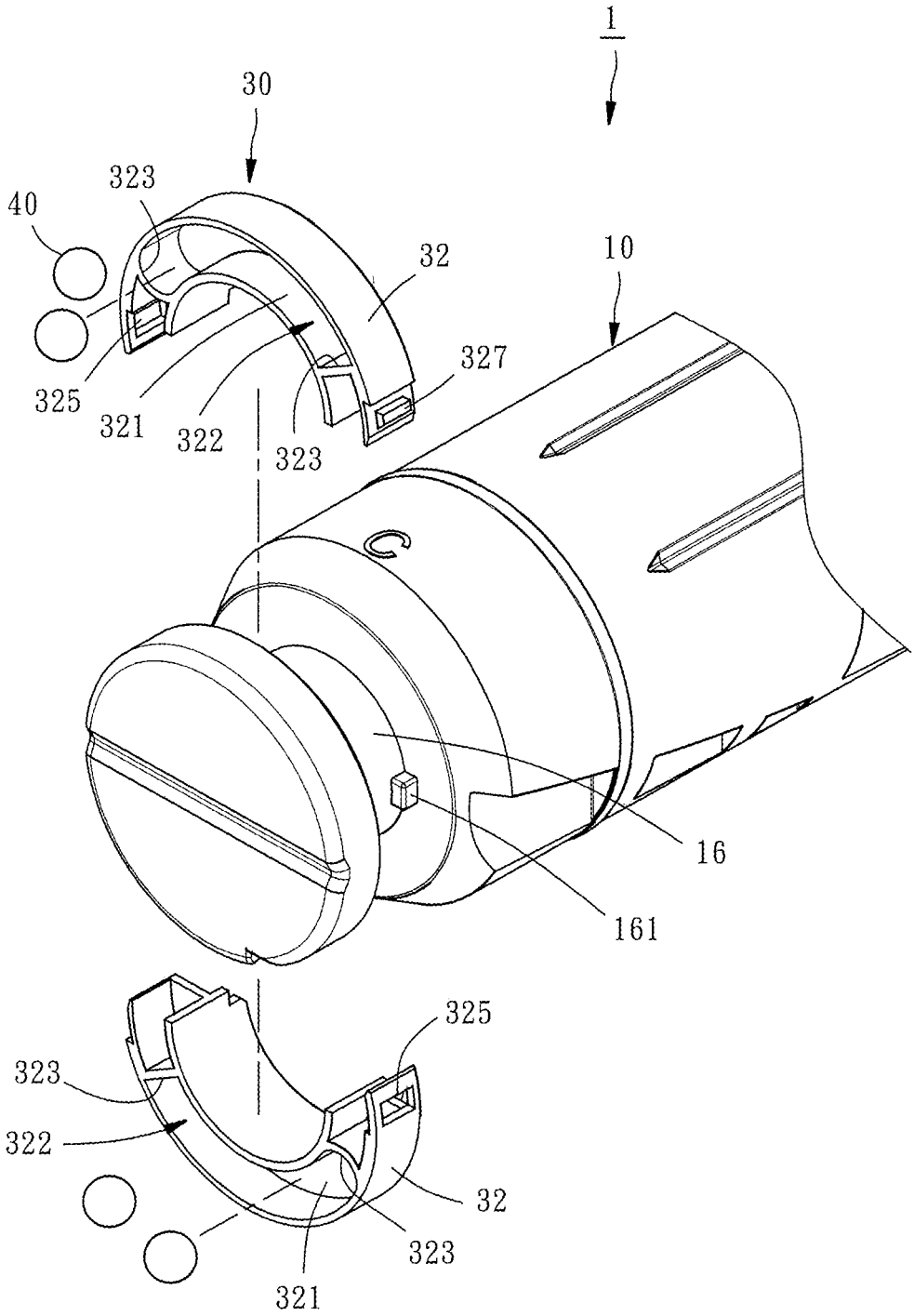
FIG. 3 is an exploded perspective view of parts of the toner cartridge according to the preferred embodiment of the present invention.

The shell 10 has an internal space 12, an opening 14, a recess 16, and an imaginary axis L. The internal space 12 accommodates carbon powder. The opening 14 is located at an end of the shell 10 and communicates with the internal space 12 and exterior of the shell for the carbon powder to pass through. The aforesaid exterior refers to the space outside of the shell 10. The recess 16, which is annular, is located adjacent to the other end of the shell 10, and provided therein with two positioning blocks 161 (referring to FIG. 3). The shell 10 can be driven by the electronic imaging device to rotate about the imaginary axis L.

The transmission member 20 has a main body 22 sleeved onto the shell 10, and a gear ring 24 provided on the periphery of the main body 22. The gear ring 24 is adapted for being engaged with a driving gear (not shown) of the electronic imaging device. The transmission member 20 can be driven to rotate in a way that the gear ring 24 is rotated by the driving gear, and drive the shell 10 to rotate together.

Figure 4:
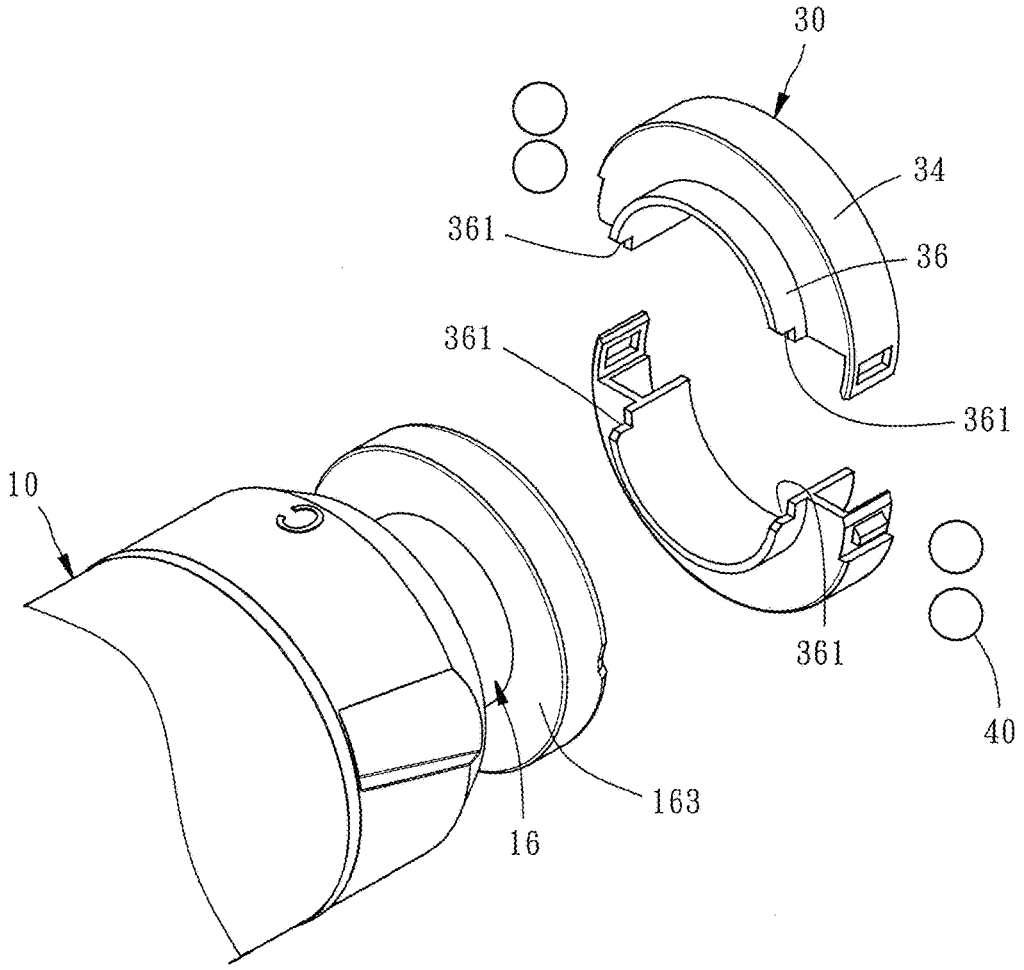
FIG. 4 is another exploded perspective view of the parts of the toner cartridge according to the preferred embodiment of the present invention.
Figure 5:
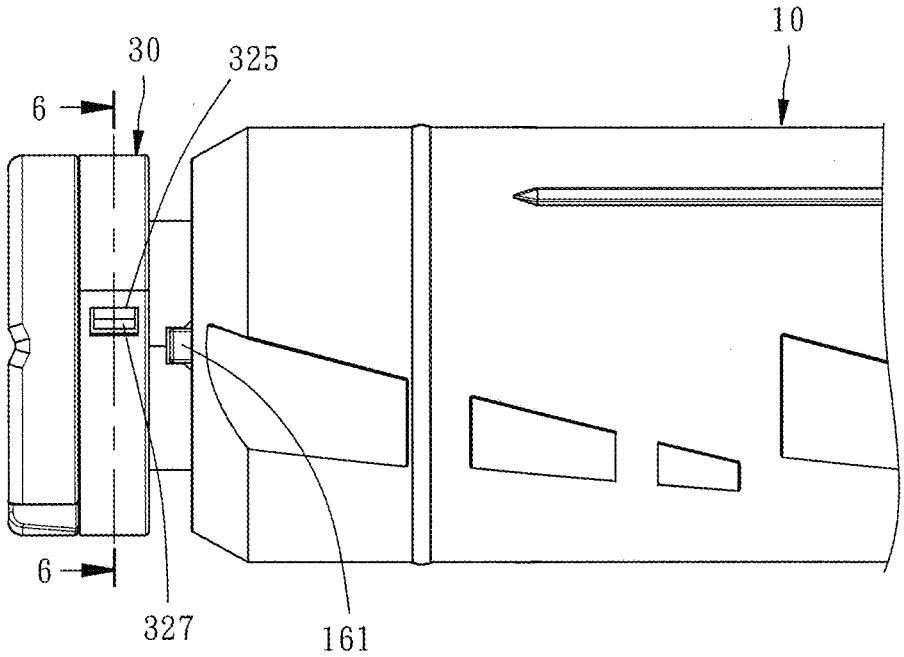
FIG. 5 is a side view of the parts of the toner cartridge according to the preferred embodiment of the present invention.
Figure 6:
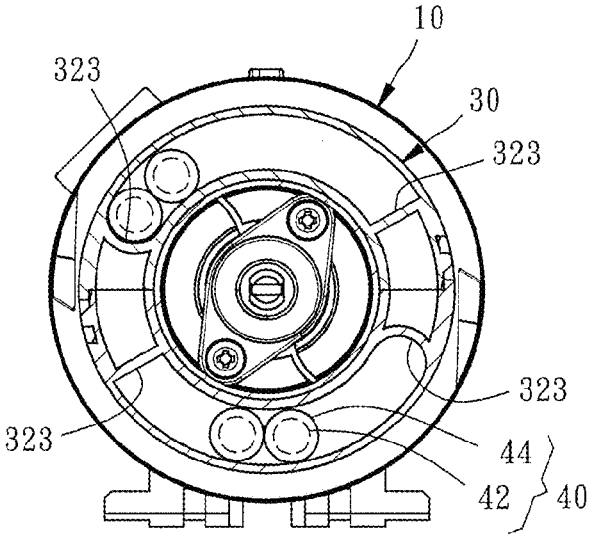
FIG. 6 is a sectional view taken along the line 6-6 in FIG. 5.
Figure 7:
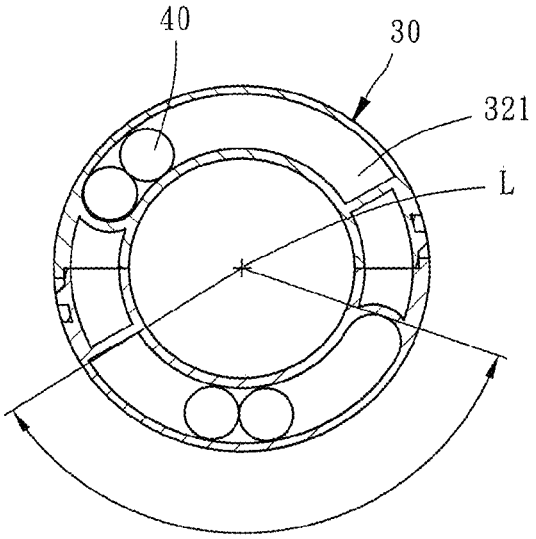
FIG. 7 is a sectional view of a sleeve according to the preferred embodiment of the present invention.

Referring to FIGS. 3-6, the sleeve 30 is disposed at the outside of the shell 10. Specifically speaking, the sleeve 30 is accommodated in the recess 16 of the shell 10, and each inner wall of the recess 16 belongs to a part of the outside of the shell 10. The sleeve 30 is annular and composed of two semi-ring members 32 coupled with each other. Each of the semi-ring members 32 has an internal path 321, two stopping portions 323 located at two ends of the internal path 321, a coupling hole 325, and a coupling block 327. The internal path 321 of each semi-ring member 32 has an opening side 322. The two opening sides 322 are abutted on the inner wall 163 of the recess 16 of the shell 10. The internal path 321 is extended along an arc-shaped imaginary line, and the tangent lines of the imaginary line are perpendicular to the imaginary axis L. In fact, the imaginary line, along which the internal path 321 is extended, is not limited to the aforesaid design, as long as it is not parallel to the imaginary axis L. Two ends of each internal path 321 and the imaginary axis L define a central angle of about 135 degrees (in fact, it can be any angle less than 180 degrees), as shown in FIG. 7. The two semi-ring members 32 are connected with each other to compose the sleeve 30 in a way that the coupling block 327 of one of the semi-ring members 32 is inserted in the coupling hole 325 of the other of the semi-ring members 32, and similarly the coupling block 327 of the latter semi-ring member 32 is inserted in the coupling hole 325 of the former semi-ring member 32. The sleeve 30 has a large radius portion 34 and a small radius portion 36, which are connected with each other. An outer radius of the large radius portion 34 is larger than an outer radius of the small radius portion 36. The small radius portion 36 has two positioning notches 361, in which the two positioning blocks 161 of the shell 10 are inserted respectively, so that the sleeve 30 is positioned on the shell 10 and will not rotate relative to the shell 10. In fact, as shown in FIG. 4, when the two semi-ring members 32 are not connected with each other, each positioning notch 361 is divided into two; when the two semi-ring members 32 are connected with each other, each positioning notch 361 becomes complete for the positioning block 161 to be inserted therein. The small radius portion 36 is primarily provided for the toner cartridge 1 to be conveniently taken by the user. In other embodiments, the sleeve 30 can have only the larger radius portion 34, but no such small radius portion 36. Besides, for the two stopping portions 323 of each internal path 321 in this embodiment, one of the stopping portions 323 is arc-shaped, and the other stopping portion 323 is straight, as shown in FIG. 6. In fact, the shapes of the stopping portions 323 are not specially limited.

Each of the two internal paths 321 of the sleeve 30 accommodates two of the four knocking blocks 40. Each of the knocking blocks 40 is ball-shaped and has a core 42, and a buffering layer 44 covering the core 42, as shown in FIG. 6. The core 42 is made of metal such as steel, and the buffering layer 44 is made of elastic material such as rubber. The knocking blocks 40 are limited in the internal paths 321 by the inner wall 163 of the recess 16, thereby incapable of escaping from the sleeve 30. In other potential embodiments, each of the internal paths 321 may have no such opening side 322, but have a stopping wall to directly stop the knocking blocks 40 from leaving the sleeve 30. The buffering layers 44 are provided for decreasing the noise which may be made when the knocking blocks 40 knock the stopping portions 323. In fact, the knocking blocks 40 may have no such buffering layer 44. The knocking blocks 40 are shaped as balls for rolling in the internal paths 321. However, the shape of the knocking blocks 40 may be modified, as long as the knocking blocks 40 can conveniently move in the internal paths 321.

When the transmission member 20 is driven to rotate in the way that the gear ring 24 is rotated by the driving gear, the shell 10 and the sleeve 30 are driven to rotate with the transmission member 20. At this time, the two knocking blocks 40 accommodated in the upper internal path 321 shown in FIG. 6 are at first abutted on one of the stopping portions 323. When this stopping portion 323 is rotated clockwise and passes the highest position, the two knocking blocks 40 roll to the right along the internal path 321 and roll down by gravity to knock the other stopping portion 323 of the internal path 321. When the knocking blocks 40 knock the stopping portion 323, the shell 10 is vibrated, so that the carbon powder sticking on the inner wall of the shell 10 is shaken off. Because the shell 10 is rotated continuously, the formerly upper internal path 321 is rotated to the downside, the formerly lower internal path 321 is rotated to the upside, and the knocking blocks 40 in the internal path 321 at the upside will knock one of the stopping portions 323 as described above. By such cycles, the carbon powder sticking on the inner wall of the shell 10 is continuously shaken off and then discharged from the shell 10. Therefore, the remnant carbon powder in the toner cartridge 1 is effectively decreased.

Based on the spirit of the present invention, the structure of the toner cartridge 1 may be modified. For example, the shell 10 may have no such recess 16, and the sleeve 30 may be disposed at the outside of the shell 10 by gluing or other ways. Alternately, the shapes of the recess 16 and the sleeve 30 may be modified, as long as the recess 16 and the sleeve 30 can match each other. For example, the recess 16 may be semi-ring-shaped, and the sleeve 30 may include only one semi-ring member 32. The positioning block 161 or the positioning notch 361 may be omitted; in such condition, the sleeve 30 may be fixed to the shell 10 by gluing or other ways. The structure or amount of the semi-ring member 32 of the sleeve 30 may be modified depending on demand. For example, the sleeve 30 may include three arc-shaped semi-ring members 32 connected with each other; in such condition, the imaginary line, along which each internal path is extended, is relatively shorter. Alternately, each semi-ring member 32 may have more than one internal path 321. The knocking block 40 accommodated in each internal path 321 can be of any amount equal to or more than one. The way of connecting the two semi-ring members 32 may be modified depending on demand. For example, one of the semi-ring members 32 may have two coupling holes 325, and the other semi-ring member 32 may have two coupling blocks 327 inserted in the two coupling holes 325 respectively. Alternately, the two semi-ring members 32 may be connected by gluing, so that the coupling hole 325 and the coupling block 327 can be omitted. The central angle defined by two ends of each internal path 321 of the sleeve 30 and the imaginary axis L can be any angle less than 180 degrees. If the aforesaid central angle is not less than 180 degrees, when one of the stopping portions 323 of the upper internal path 321 passes the highest position, the other stopping portion 323 has been left the lowest position, thereby unable to be knocked by the knocking blocks 40 rolling down along the internal path 321, so that the effect of vibrating the shell 10 can't be achieved.

What is claimed is:

1. A toner cartridge comprising:

a shell having an internal space, an opening communicating with the internal space and exterior of the shell, and an imaginary axis, and rotatable about the imaginary axis;

a sleeve disposed at an outside of the shell and comprising an internal path extended along an imaginary line not parallel to the imaginary axis, and two stopping portions located at two ends of the internal path; and a knocking block accommodated in the internal path of the sleeve, and movable along the internal path to knock the stopping portion of the sleeve when the shell rotates.

2. The toner cartridge as claimed in claim 1, wherein the shell has a recess, in which the sleeve is accommodated.

3. The toner cartridge as claimed in claim 2, wherein the recess is annular, and the sleeve is also annular.

4. The toner cartridge as claimed in claim 3, wherein the sleeve has a large radius portion and a small radius portion, which are connected with each other; wherein an outer radius of the large radius portion is larger than an outer radius of the small radius portion.

5. The toner cartridge as claimed in claim 3, wherein the recess of the shell is provided therein with a positioning block; the sleeve has a positioning notch, in which the positioning block is inserted.

6. The toner cartridge as claimed in claim 3, wherein the sleeve is composed of two semi-ring members coupled with each other.

7. The toner cartridge as claimed in claim 6, wherein the internal path of the sleeve has an opening side abutted on an inner wall of the recess of the shell.

8. The toner cartridge as claimed in claim 6, wherein each of the semi-ring members has a said internal path; the toner cartridge has two said knocking blocks accommodated in the internal paths of the two semi-ring members respectively.

9. The toner cartridge as claimed in claim 6, wherein each of the semi-ring members has a coupling hole and a coupling block; the two semi-ring members are connected with each other in a way that the coupling block of one of the semi-ring members is inserted in the coupling hole of the other of the semi-ring members.

10. The toner cartridge as claimed in claim 1, wherein the knocking block is ball-shaped.

11. The toner cartridge as claimed in claim 1, wherein the knocking block has a core, and a buffering layer covering the core.

12. The toner cartridge as claimed in claim 1, wherein the internal path of the sleeve and the imaginary axis define a central angle of less than 180 degrees.

* * * * *